US007828861B1

(12) United States Patent
Wong

(10) Patent No.: US 7,828,861 B1
(45) Date of Patent: Nov. 9, 2010

(54) METHOD OF FORMING FUEL MIXTURE FOR COMPRESSION IGNITION DEVICE

(76) Inventor: Ralph Wong, One Wong Way, Marana, AZ (US) 85653

( * ) Notice: Subject to any disclaimer, the term of this patent is extended or adjusted under 35 U.S.C. 154(b) by 514 days.

(21) Appl. No.: 11/953,208

(22) Filed: Dec. 10, 2007

Related U.S. Application Data

(60) Provisional application No. 60/874,352, filed on Dec. 12, 2006.

(51) Int. Cl.
*C10L 1/10* (2006.01)

(52) U.S. Cl. ..... 44/300; 123/1 A

(58) Field of Classification Search ..... 44/300; 123/1 A

See application file for complete search history.

(56) References Cited

U.S. PATENT DOCUMENTS

| | | | | |
|---|---|---|---|---|
| 4,095,571 | A | 6/1978 | Fleetwood et al. | |
| 4,360,436 | A | 11/1982 | Poveromo | |
| 4,417,561 | A | 11/1983 | Yasuhara | |
| 5,336,396 | A | 8/1994 | Shetley | |
| 5,353,760 | A | 10/1994 | Zager | |
| 5,871,618 | A * | 2/1999 | Lee et al. | 196/46.1 |
| 6,187,063 | B1 | 2/2001 | Gunnerman | |
| 6,364,917 | B1 * | 4/2002 | Matsumura et al. | 44/301 |
| 6,471,005 | B1 | 10/2002 | Zager | |
| 6,892,531 | B2 | 5/2005 | Rim | |
| 2005/0061262 | A1 * | 3/2005 | Wong | 123/1 A |

FOREIGN PATENT DOCUMENTS

| | | |
|---|---|---|
| GB | 2234519 A | 6/1991 |
| WO | WO 97/27270 | 7/1997 |
| WO | WO 00/37590 | 6/2000 |
| WO | WO 03/033626 A3 | 4/2003 |

* cited by examiner

*Primary Examiner*—Cephia D Toomer
(74) *Attorney, Agent, or Firm*—Lawrence R. Oremland, P.C.

(57) ABSTRACT

A new and useful way of producing a used oil fuel mixture for a compression ignition engine is provided. A mass of used oil from which water has been substantially removed, is initially filtered, e.g. to remove particles greater than a predetermined size. The used oil is then centrifuged, under predetermined conditions to remove any remaining water and to remove particles to a predetermined size level. The drained, filtered and centrifuged used oil is then mixed with fuel (e.g. diesel fuel) in a predetermined ratio, to form a used oil fuel mixture and optionally adding an additive (e.g. a diesel fuel additive) to the used oil fuel mixture. Then, the used oil fuel mixture is centrifuged to promote mixing, and the centrifuged used oil fuel mixture is then pumped through one or more final filtering stages, to produce the used oil fuel mixture that is useful with compression ignition engines.

9 Claims, 1 Drawing Sheet

METHOD OF FORMING FUEL MIXTURE FOR COMPRESSION IGNITION DEVICE

RELATED APPLICATION/CLAIM OF PRIORITY

This application is related to and claims priority from provisional application Ser. No. 60/874,352, filed Dec. 12, 2006, which provisional application is incorporated by reference herein.

TECHNICAL FIELD

The present invention relates generally to a fuel mixture, more particularly, to a fuel mixture for a compression ignition device, and even more particularly to a way of forming the fuel mixture.

BACKGROUND OF THE INVENTION

The objective of the present invention is Energy Recovery. Since 1974 energy demand has risen to the point that it affects all energy users. In the industrial world there is a lot of waste that is not addressed. Used oil, e.g. used motor oil, currently has very little economical use. Used oil is known to have about 150,000 BTU per gallon. That is more than diesel, gasoline or jet fuel. The objective of the present invention is to be able to recover the energy of used oil in a way that is effective and economical. Such energy recovery can come, e.g., from used motor oil that is generally considered a waste product.

In the applicant's experience, used oil products currently are being incinerated or are being used as fuels for space heaters. Most generators pay to get rid of used oil which is considered waste product, and such waste product has relatively little economic value. The present invention recognizes that used oil based products have energy that could recovered, and be used for a higher economic value (e.g. as fuel for compression ignition devices.

SUMMARY OF THE INVENTION

The present invention addresses these problems by providing a way of forming a fuel mixture that uses used oil to provide a fuel mixture for use with compression ignition devices (e.g. Diesel engines, turbine jet engines, etc.). The invention recovers energy from such used oil and puts that energy into a higher economic use, as a fuel for a compression ignition device.

According to the present invention, a mass of used oil from which water has been substantially removed, is initially filtered, e.g. to remove particles greater than a predetermined size (e.g. 40 microns). The used oil is then centrifuged, under predetermined conditions to remove any remaining water and to remove particles to a predetermined size level. The drained, filtered and centrifuged used oil is then mixed with fuel (e.g. diesel fuel) in a predetermined ratio, to form a used oil fuel mixture and optionally adding an additive (e.g. a diesel fuel additive) to the used oil fuel mixture. Then, the used oil fuel mixture is centrifuged to promote mixing, and the centrifuged used oil fuel mixture is then pumped through one or more final filtering stages, to produce the oil fuel mixture that is useful with compression ignition engines.

Further features of the present invention will become apparent from the following detailed description and the accompanying drawing.

DETAILED DESCRIPTION

Figure 1:
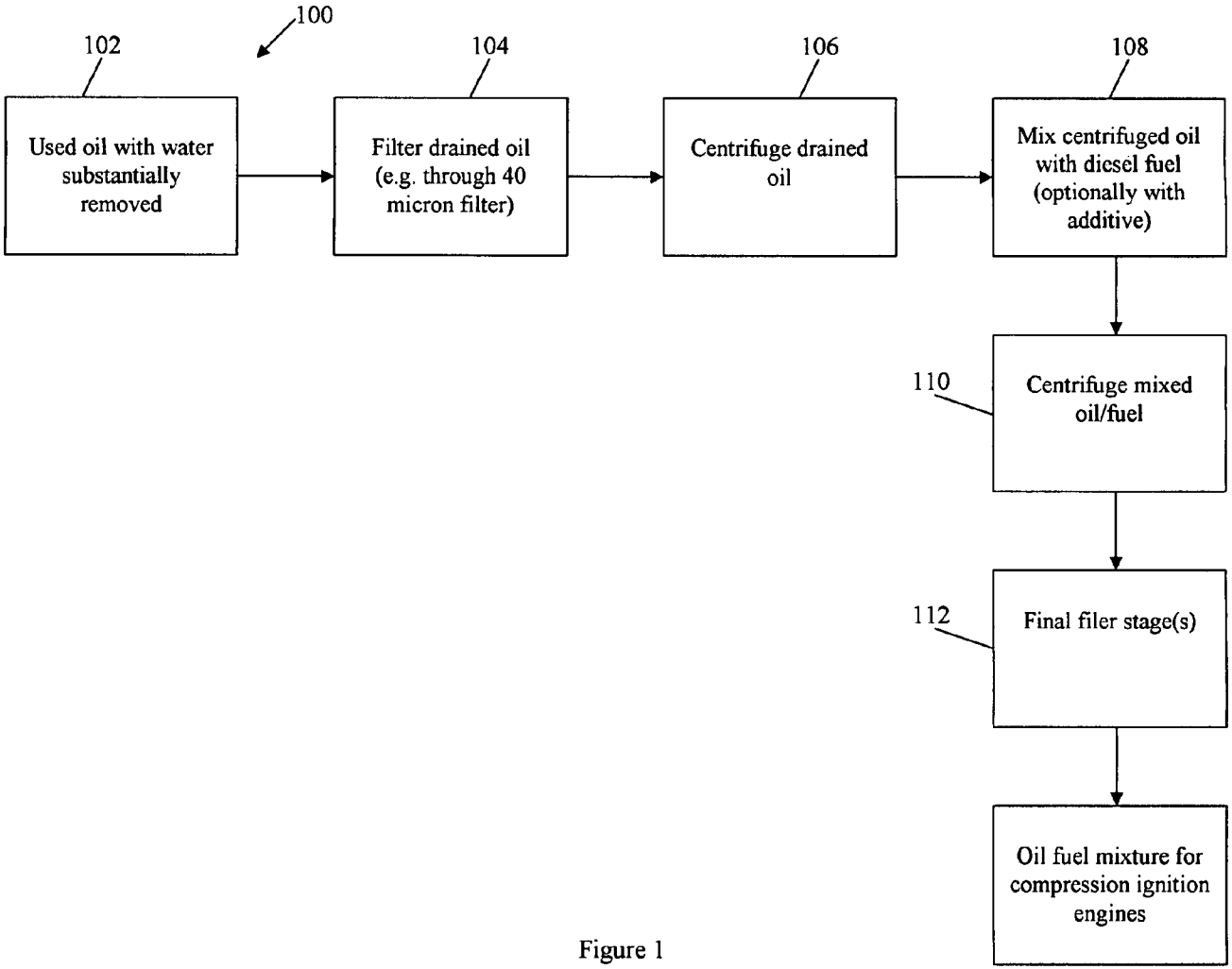
FIG. 1 is a schematic illustration of the manner in which a used oil fuel mixture is produced, according to the principles of the present invention.

As described above, the present invention provides a way of forming a fuel mixture that uses used oil to provide a fuel mixture for use with compression ignition devices (e.g. Diesel engines). The invention recovers energy from such used oil and puts that energy into a higher economic use, as a fuel for a compression ignition device.

According to the present invention, a mass of used oil from which water has been substantially removed, is initially filtered, e.g. to remove particles greater than a predetermined size (e.g. 40 microns). The used oil is then centrifuged, under predetermined conditions to remove any remaining water and to remove particles to a predetermined size level. The drained, filtered and centrifuged used oil is then mixed with fuel (e.g. diesel fuel) in a predetermined ratio, to form a used oil fuel mixture and optionally adding an additive (e.g. a diesel fuel additive) to the used oil fuel mixture. Then, the used oil fuel mixture is centrifuged to promote mixing, and the centrifuged the oil fuel mixture is then pumped through one or more final filtering stages, to produce the oil fuel mixture that is useful with compression ignition engines.

As shown in FIG. 1, the present invention provides a system 100 for producing the used oil fuel mixture. Initially, as shown at 102, a mass of used oil from which water has been substantially removed is provided, either by acquiring the drained, used oil from an external source or by draining the water from a mass of recovered fuel oil. As shown at 104, that mass of drained used oil is filtered to remove particles greater than a predetermined size (e.g. 40 microns). Then, as shown at 106, the used oil is then centrifuged, under predetermined conditions to remove any remaining water and to remove particles to a predetermined size level. Then, as shown at 108, the drained, filtered and centrifuged used oil is mixed with diesel fuel in a predetermined ratio, to form a used oil fuel mixture and optionally adding a diesel additive to the used oil fuel mixture. Then, as shown at 110, the used oil fuel mixture is centrifuged to promote mixing, and as shown at 112 the centrifuged used oil fuel mixture is then pumped through one or more final filtering stages, to produce the used oil fuel mixture that is useful with compression ignition engines.

The centrifuging of the used oil, shown at 106 in FIG. 1, preferably comprises removing particles larger than 1.5 to 2 microns in size. That centrifuging step preferably comprises substantially continuously centrifuging a predetermined mass of used oil at a predetermined rate and pressure for a predetermined time period. By "substantially continuously" centrifuging applicant means that the centrifuge would typically run round the clock for the predetermined time period, but the centrifuge may be temporarily stopped periodically to allow removal of particles that have been forced outward by the operation of the centrifuge. The centrifuge may have paper on its outer wall that catches and retains the particles (down to a 1.5 to 2 micron size), so the centrifuge may be temporarily stopped to allow removal and replacement of the paper. Alternatively, if the centrifuge does not have paper, the particles (down to the 1.5-2 micron range) will collect against the wall of the centrifuge, so that centrifuge may be temporarily stopped to allow the particles to be cleaned off (i.e. scraped from) the walls of the centrifuge.

In centrifuging the used oil, to remove particles down to the 1.5-2 micron range, the centrifuge should be run to generate centrifuge pressures of about 2,500 to 3,000 times the force of gravity within the centrifuge. For example, a mass of 200 gallons of used oil that is centrifuged at a rate of about 5 gallons per minute and a pressure of about 100 psi should produce those conditions within the centrifuge, and should enable particles to the 1.5-2 micron range to be removed from the used oil. Also, centrifuging under the foregoing conditions will help remove any remaining water in the used oil. The used oil is centrifuged in this fashion substantially continuously for about 6 days, and the paper in the centrifuge is periodically changed to remove particles from the oil.

Then, the centrifuged used oil is mixed with fuel such as diesel fuel. Preferably, the used oil is mixed with fuel in a ratio of about 2 to 1 (e.g. about 200 gallons of centrifuged used oil to about 90-100 gallons of diesel fuel). That 2 to 1 ratio can change slightly to accommodate differing temperature/humidity conditions in which the final oil/fuel mixture is expected to operate. Thus, for low humidity higher temperature conditions, it may be desirable to increase the diesel proportion by up to about 30% to cut down white smoke. On the other hand, for low temperature conditions, it may be acceptable to decrease the diesel fuel by about 10-15% and still achieve acceptable engine performance. Thus, a ratio of "about 2 to 1" is intended to encompass a diesel proportion that can be increased up to 30% for high temperature/low humidity conditions, and that can be decreased by 10-15% for low temperature conditions.

After the used oil and diesel fuel are mixed, the mixture is centrifuged for about 2 hours to promote mixing of the used oil and fuel. Then the centrifuged used oil fuel mixture is pumped through a pair of filters. Preferably, wherein the centrifuged used oil fuel mixture is first pumped through a 10 micron filter and thereafter through a 5 micron filter. At that point, the oil/fuel mixture is ready for use in compression ignition (e.g. diesel) engines.

The following additional features of the present invention are believed worth noting.

a. Since the waste oil has energy that could be recovered and used for economical gain, the present invention puts such waste oil into a higher beneficial use for users of energy, by providing a way of producing a fuel mixture that is particularly useful with existing compression ignition engines.

b. In this application, the term "used oil" is intended to mean oil or an oil mixture that is otherwise a waste product of a facility. Used oil also includes oil or an oil mixture that has been stored and not used during the period in which its use has been recommended (i.e. it is "too old"). Potential sources of used oil include maintenance shops, automotive facilities, industrial facilities, etc.

c. Regarding the effect of temperature on the ratio of used oil to fuel, as described above, the preferred ratio of used oil to fuel is about 2 to 1, but cooler temperatures (e.g. below 70 degrees F.) allow a lower percentage of fuel (e.g. 10-15% lower) to be used in the used oil fuel mixture. Warmer temperatures (e.g. above 95 degrees F.), and lower humidity, would normally suggest a higher percentage of fuel (e.g. up to 30% higher).

d. Number 2 Diesel from almost any source can be used as the fuel that is mixed with the used oil. However under very cold conditions (i.e. below freezing), Number 1 Diesel fuel would be preferred over Number 2 Diesel. Additionally, up to 10% (by volume) gasoline is believed useful in very cold conditions.

e. An additive such as RL 3 diesel additive may be useful to add to the oil fuel mixture, before the used oil fuel mixture is centrifuged.

f. The used oil used in the mixture according to the present invention includes almost all types of used oils that would be generally generated at a motor service shop. The used oil can also include different grades of oil and transmission fluids. Water is the only item that is not desired. Since water is heavier than oil, it could be easily separated from the mixture. For example, since water is significantly heavier than used motor oil, the water can be separated from the used oil by settling (for about ½ day) and then draining the separated water from the used oil. Alternatively, the water can be separated by a water separator filter such as a "RACOR" filter, produced by RACOR, of Fresno, Calif.

g. Since jet fuel is very close to diesel it can be used as the fuel. Jet fuel has slightly less energy and is a little lighter than diesel fuel, and should mix very well with used oil. For valve engines the jet fuel does not have the oiling required to keep the valves from burning up. By mixing the used oil with the jet fuel, in about the same relative proportion to which the used oil is mixed with diesel fuel, the valve problem is addressed. The jet fuel used in such a mixture can be provided, e.g., from the residue of commercial airliners.

h. Since used motor oil is inherently dirty, filtering is provided to protect components of the engine, including but not limited to the fuel injection system and reciprocating parts of the engine, as will be readily appreciated by those in the art. As seen from the foregoing description, it is preferred that the used oil be filtered before the oil is mixed with the fuel, and it is also preferred that the oil/fuel mixture be filtered. One type of filter comprises stainless steel mesh that is cleanable with solvent or water. A primary filter is the type of wire mesh used as a window screen. The preferred primary filter can be, e.g. a 40-micron stainless steel mesh. It may be desirable to filter the used oil fuel mixture through both 10 micron and then 5 micron filters to produce the final oil/fuel produce. Those filters can be steel mesh or filter paper. The speed at which the used oil can be run through the steel mesh filters can be relatively fast (e.g. about 10 gallons per minute (gpm)), and at slower speeds through paper filters to remove particles that might slip through the stainless steel filters.

Once the used oil fuel mixture is produced, in the manner described above, the oil fuel mixture should stay mixed for several days. Standard procedure is to pump mix a few minutes before fueling a vehicle is desired.

Thus, as seen from the foregoing description, the present invention provides a fuel mixture for a compression ignition device, comprising a mixture of used oil and fuel material produced in a manner that increases the fuel efficiency of the device in comparison to the efficiency of the device when operated without the used oil.

As described above, the present invention relates to a way of producing a fuel mixture for a compression ignition device. The principles of the present invention are described above in connection with a fuel mixture for a diesel engine. However, it will be clear to those in the art that the principles of the present invention can be used to create a fuel mixture for other types of compression ignition devices.

The invention claimed is:

1. A method of providing a fuel mixture for a compression ignition device, comprising the steps of a. providing a mass of used oil from which water has been substantially removed by draining, b. filtering the mass of used oil to remove particles greater than a predetermined size, c. centrifuging the used oil under predetermined conditions to remove any remaining water and to remove particles to a predetermined size level, d. mixing the drained, filtered and centrifuged used oil with fuel in a predetermined ratio, to form a used oil fuel mixture and optionally adding a fuel additive to the used oil fuel mixture, e. centrifuging the used oil fuel mixture to promote mixing, and f. pumping the used oil fuel mixture through one or more final filtering stages.

2. A method as set forth in claim 1, wherein the step of centrifuging the used oil comprises removing particles larger than about 1.5 to 2 microns in size.

3. A method as set forth in claim 1, wherein the step of centrifuging the used oil comprises the step of substantially continuously centrifuging a mass of used oil under conditions that generate pressures of about 2,500 to 3,000 times the force of gravity for a predetermined time period.

4. A method as set forth in claim 3, wherein a mass of about 200 gallons of used oil is centrifuged at a rate of about 5 gallons per minute and a pressure of about 100 psi to generate pressures about 2,500 to 3,000 times the force of gravity in the centrifuge.

5. A method as set forth in claim 3, wherein the used oil is substantially continuously centrifuged for about 6 days, and particles are periodically removed from the centrifuge.

6. A method as set forth in claim 5, wherein the used oil is mixed with fuel in a ratio of about 2 to 1.

7. A method as set forth in claim 6, wherein the used oil fuel mixture is centrifuged for about 2 hours to promote mixing of the used oil and fuel.

8. A method as set forth in claim 7, wherein the centrifuged used oil fuel mixture is pumped through a pair of filters.

9. A method as set forth in claim 8, wherein the centrifuged used oil fuel mixture is first pumped through a 10 micron filter and thereafter through a 5 micron filter.

* * * * *